United States Patent [19]

Fujiwara

[11] Patent Number: 4,547,062

[45] Date of Patent: Oct. 15, 1985

[54] COPY PAPER SUPPLY TIMING CONTROL IN A COPYING MACHINE

[75] Inventor: Katsuyoshi Fujiwara, Osaka, Japan

[73] Assignee: Sharp Kabushiki Kaisha, Osaka, Japan

[21] Appl. No.: 506,973

[22] Filed: Jun. 23, 1983

[30] Foreign Application Priority Data

Jun. 25, 1982 [JP] Japan ..... 57-110517

[51] Int. Cl.[4] ..... G03G 15/00; G03G 21/00

[52] U.S. Cl. ..... 355/14 R; 355/14 C; 355/3 DR; 355/14 SH

[58] Field of Search ..... 355/14 R, 14 SH, 14 C, 355/3 DR

[56] References Cited

U.S. PATENT DOCUMENTS 4,248,527 2/1981 Akiyama ..... 355/14 R

*Primary Examiner*—A. T. Grimley
*Assistant Examiner*—Carl Romano
*Attorney, Agent, or Firm*—Birch, Stewart, Kolasch & Birch

[57] ABSTRACT

A copy paper supply timing control system includes a slit plate secured to a shaft of a photo-sensitive drum for developing a pulse signal of a period (t') in response to the rotation of the photo-sensitive drum. A copy paper supply system is enabled when a predetermined time has passed after an optical system initiates its movement. The predetermined time is determined by a number (N) of the pulse signals and a time period (T) from the development of the N-th pulse signal. That is, the actual copy paper supply is conducted when $(N \times t' + T)$ have passed after the optical system initiated its movement. The copy paper supply timing control system includes a compensation system for modifying the pulse number (N) and the time period (T) in response to a detected period (t) between the initiation of the optical system movement and the development of the first pulse signal.

2 Claims, 5 Drawing Figures

COPY PAPER SUPPLY TIMING CONTROL IN A COPYING MACHINE

BACKGROUND AND SUMMARY OF THE INVENTION

The present invention relates to a copy paper supply timing control system in a copying machine of the optical system reciprocating type.

Generally, there are two types of timing control systems for controlling the copy paper supply timing. The first type includes a slit plate secured to a shaft of a photosensitive drum. The slit plate has a plurality of slits formed at predetermined positions. Each slit provides a control signal for activating respective elements in the copying machine at desired timings. In this type, the installation of the slit plate requires high accuracy. Moreover, the first type control system is not applicable to a copying machine having an endless photosensitive drum.

The second type includes a slit plate which has slits periodically formed with a predetermined interval. The second type further includes a detection switch for detecting the start point of the reciprocating optical system. A control signal is developed when a preselected number of slits are counted after generation of a detection signal from the detection switch, the control signal being applied to a drive system for activating the elements in the copying machine. This type of the conventional system can not avoid the error up to a magnitude corresponding to the period of the slits. If the error should be reduced, the slit interval must be reduced. This will complicate the slit detection system. Furthermore, even when fine slits are formed, there still exists the error determined by the interval of the slits.

Accordingly, an object of the present invention is to provide a timing control system in a copying machine of the optical system reciprocating type.

Another object of the present invention is to accurately control the copy paper supply timing in a copying machine.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

The present invention relates to an improvement over the above-mentioned second type. To achieve the above objects, pursuant to an embodiment of the present invention, a slit plate is secured to a shaft of the photosensitive drum. The slit plate has periodical slits with a predetermined distance therebetween. The copy paper supply timing is controlled so that the copy paper supply is initiated when a preselected time (T) has passed after a predetermined number (N) of slits have been counted from the development of a detection signal derived from an optical system start detection sensor. The preselected time (T), which is selected shorter than a period t' of the slit output, functions to adjust for accurate timing for conducting the copy paper supply.

In a preferred mode, a control circuit is provided which compensates the displacement of the timing of the occurrence of the first slit pulse. The control circuit includes a timer for counting a time period (t) from the development of the detection signal from the optical system start detection sensor to the occurrence of the first slit pulse. When the time period (t) is shorter than or equal to the preselected time (T), the copy paper supply is initiated when $(T-t)$ seconds have passed after the predetermined number (N) of slits have been counted. When the time period (t) is longer than the preselected time (T), the copy paper supply is initiated when $(T+t'-t)$ seconds have passed after the $(N-1)$ slits have been counted, wherein t' is the period of the slit pulses.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Figure 1:
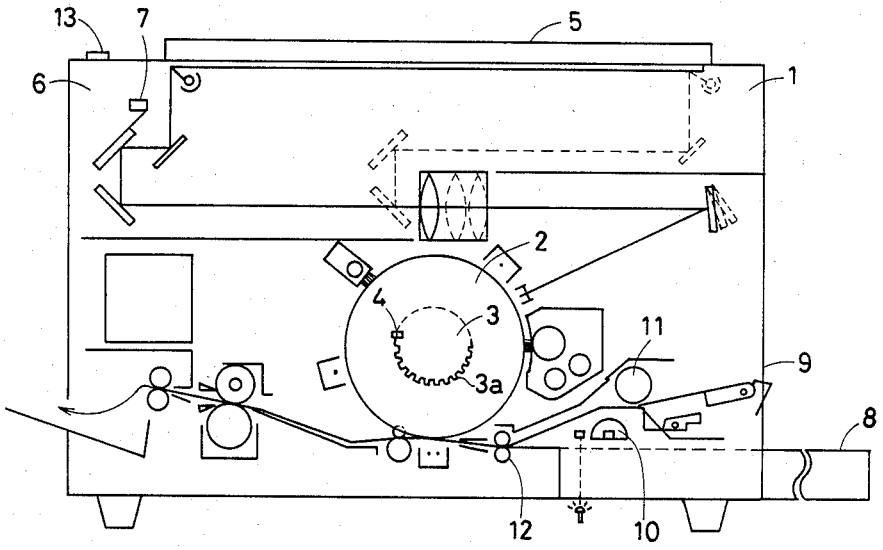
FIG. 1 is a schematic sectional view of a copying machine including an embodiment of a copy paper supply timing control system of the present invention.

A main body 1 of a copying machine includes a photosensitive drum 2 disposed at the middle of the main body 1. A slit plate 3 is secured to the shaft of the photosensitive drum 2 so that the slit plate 3 rotates in unison with the photosensitive drum 2. The slit plate 3 has a plurality of periodical slits 3*a* which are aligned with a predetermined interval therebetween.

A photo-sensor device 4 is disposed at a predetermined position in order to detect the periodical slits 3*a* formed in the slit plate 3. That is, when the slit plate 3 rotates, the photo-sensor device 4 develops a pulse signal of a period (t').

An optical system 6 is driven to reciprocate under a document table 5 for scanning the document disposed on the document table 5. The optical system 6 is normally placed at the stand-by position (shown by the solid line in FIG. 1), wherein a start point detecting switch 7 is held at the on state. A copy paper is supplied from either a copy paper cassette 8 or a manual inlet 9 by means of an automatic supply roller 10 or a manual supply roller 11. The thus introduced copy paper is temporarily stopped at a paper supply timing roller 12 which is normally held stationary. The copy paper supply timing control system is enabled under these conditions, namely, the copy paper is held at the paper supply timing roller 12 and the optical system 6 is held stationary at the stand-by position when the start point detecting switch 7 is in the on state. The photosensitive drum 2 and the slit plate 3 perform the rotating operation when the timing control system is placed in the stand-by condition.

The optical system 6 is driven to reciprocate by a motor, a drive mechanism and a clutch mechanism. The paper supply timing roller 12 is associated with a solenoid mechanism so that the paper supply timing roller 12 rotates when the solenoid is on. A copy button 13 is provided on the keyborad panel of the main body 1 to instruct the initiation of the copying operation.

Figure 2:
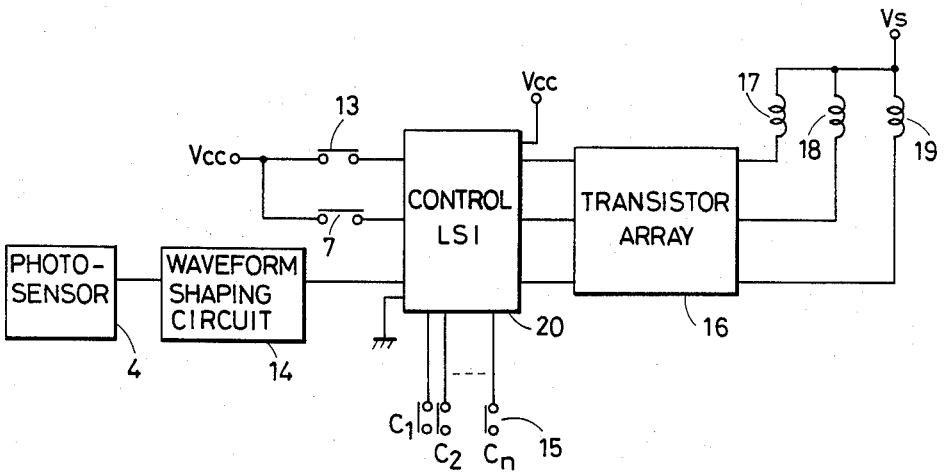
FIG. 2 is a schematic block diagram of an embodiment of a copy paper supply timing control system of the present invention.

FIG. 2 shows the copy paper supply timing control system. Like elements corresponding to those of FIG. 1 are indicated by like numerals.

The copy paper supply timing control system includes a control LSI 20 made of a one-chip microcomputer. The copy button 13, the start point detecting switch 7, and a waveform shaping circuit 14 connected to the photosensor device 4 are connected to input terminals of the control LSI 20. Furthermore, an adjusting switch array 15 is connected to the control LSI 20 for adjusting constant values stored in the control LSI 20. A transistor array chip 16 of the Darlington construction is connected to output terminals of the control LSI 20 in order to control a motor relay 17, a clutch 18 and a solenoid 19. The motor relay 17 is associated with the motor for driving the photosensitive drum 2, the optical system 6, and the copy paper supply system including the automatic supply roller 10, the manual supply roller 11 and the paper supply timing roller 12. The clutch 18 is associated with the optical system 6 so as to determine the drive timing of the optical system 6. The solenoid 19 is associated with the paper supply timing roller 12 so that the paper supply timing roller 12 is stopped when the solenoid 19 is off, and is driven to rotate when the solenoid 19 is on.

Figure 3:
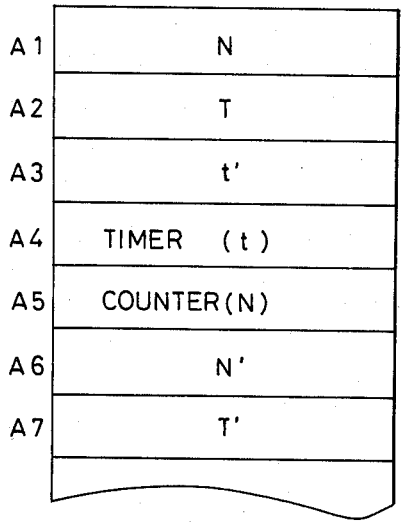
FIG. 3 is a schematic chart showing memory areas in a random access memory included in a control LSI within the copy paper supply timing control system of FIG. 2.

The control LSI 20 includes a random access memory (RAM) having memory areas as shown in FIG. 3. The memory area A1 stores a predetermined number (N) of slit pulses which should be counted from the initiation of the travel of the optical system 6 to the initiation of the rotation of the paper supply timing roller 12. The memory area A2 stores a preselected time (T) which should be passed before initiating the rotation of the paper supply timing roller 12 after the slit pulses have been counted to the predetermined number (N). Generally, the memory areas A1 and A2 first store reference values $N_0$ and $T_0$, respectively. By the testing operation in the factory, the reference values $N_0$ and $T_0$ may be modified to the specific values N and T, in accordance with the characteristics of the copying machine, through the use of the adjusting switch array 15. Accordingly, the predetermined number (N) and the preselected time (T) are fixed values for controlling the paper supply timing. If desired, the predetermined number (N) and the preselected time (T) may be modified by a repairman through the use of the adjusting switch array 15. The memory area A3 stores the period t' of the slit pulses output from the waveform shaping circuit 14. That is, the system is constructed to initiate the rotation of the paper supply timing roller 12 when a period of time $(N \cdot t' + T)$ has passed after the start point detecting switch 7 detects the start of the optical system 6.

The memory area A4 functions as a timer for counting a time period (t) commencing at the turning off of the start point detecting switch 7 and ending at the development of the first slit pulse. The memory area A5 functions as a counter for counting slit pulses after the start point detecting switch 7 is switched off. The random access memory (RAM) further includes memory areas A6 and A7 for temporarily storing a desired pulse number (N') and a desired time (T'), respectively, which are calculated through the use of the counted time period (t) stored in the memory area A4, the predetermined number (N) stored in the memory area A1, and the preselected time (T) stored in the memory area A2. The thus obtained pulse number (N') and the desired time (T') are used to control the copy paper supply timing at the actual copying operation.

Figure 4:
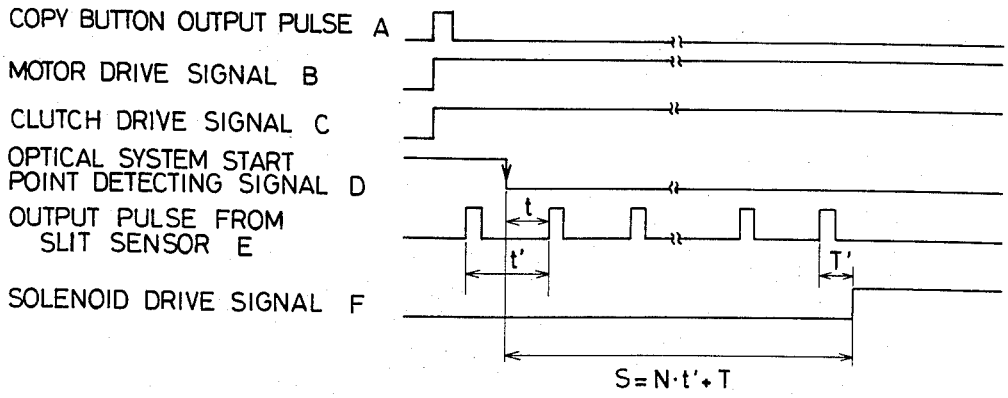
FIG. 4 is a time chart for explaining an operational mode of the copy paper supply timing control system of FIG. 2.

More specifically, when the copy button 13 is actuated, a copy button output pulse A is developed as shown in the time chart of FIG. 4. In response to the copy button output pulse A, a motor drive signal B and a clutch drive signal C are developed to rotate the photosensitive drum 2 and the automatic supply roller 10. The slit pulse is periodically developed with a period (t') in response to the rotation of the slit plate 3, and the copy paper is supplied to the paper supply timing roller 12 and is held stationary at the paper supply timing roller 12. When a certain time has passed, the optical system 6 moves forward to turn off the start point detecting switch 7, whereby an optical system start point detecting signal D bears the logic low. In response to the trailing edge of the optical system start point detecting signal D, the timer (memory area A4) initiates the counting operation. A reference clock signal of the control LSI 20 is used to count the time period (t) which represents a time period from the initiation of the movement of the optical system 6 to the development of the first slit pulse.

When the counted time period (t) is shorter than or equal to the preselected time (T) stored in the memory area A2, the control LSI 20 functions to introduce into the memory area A6 the number (N') identical to the predetermined number (N) stored in the memory area A1, and to introduce into the memory area A7 the desired time (T') which is $(T-t)$. That is, in this case the control time period $(N \cdot t' + T)$ is counted in a manner, $(t + N \cdot t' + (T-t))$. Contrarily, when the counted time period (t) is longer than the preselected time (T), the control LSI 20 functions to introduce the number (N') equalling $(N-1)$, into the memory area A6, and to introduce the desired time (T'), which is $(T+t'-t)$, into the memory area A7. That is, in this case the control time period $(N \cdot t' + T)$ is counted in a manner, $(t + (N-1) \cdot t' + (T+t'-t))$. The thus obtained pulse number (N') and the desired time (T') are used to control the copy paper supply timing. More specifically, when the actual counting operation of the slit pulses and the time period after the last slit pulse reaches the pulse number (N') stored in the memory area A6 and the time (T') stored in the memory area A7, respectively, a solenoid drive signal F is developed as shown in FIG. 4 to activate the solenoid 19. The paper supply timing roller 12 starts the rotating operation to transfer the copy paper toward the transcription section. Accordingly, the copy paper supply timing is accurately controlled without regard to variations in the generation timing of the trailing edge of the optical system start point detecting signal D.

An operational mode of the copy paper supply timing control system of the present invention will be described with reference to FIG. 5.

Figure 5:
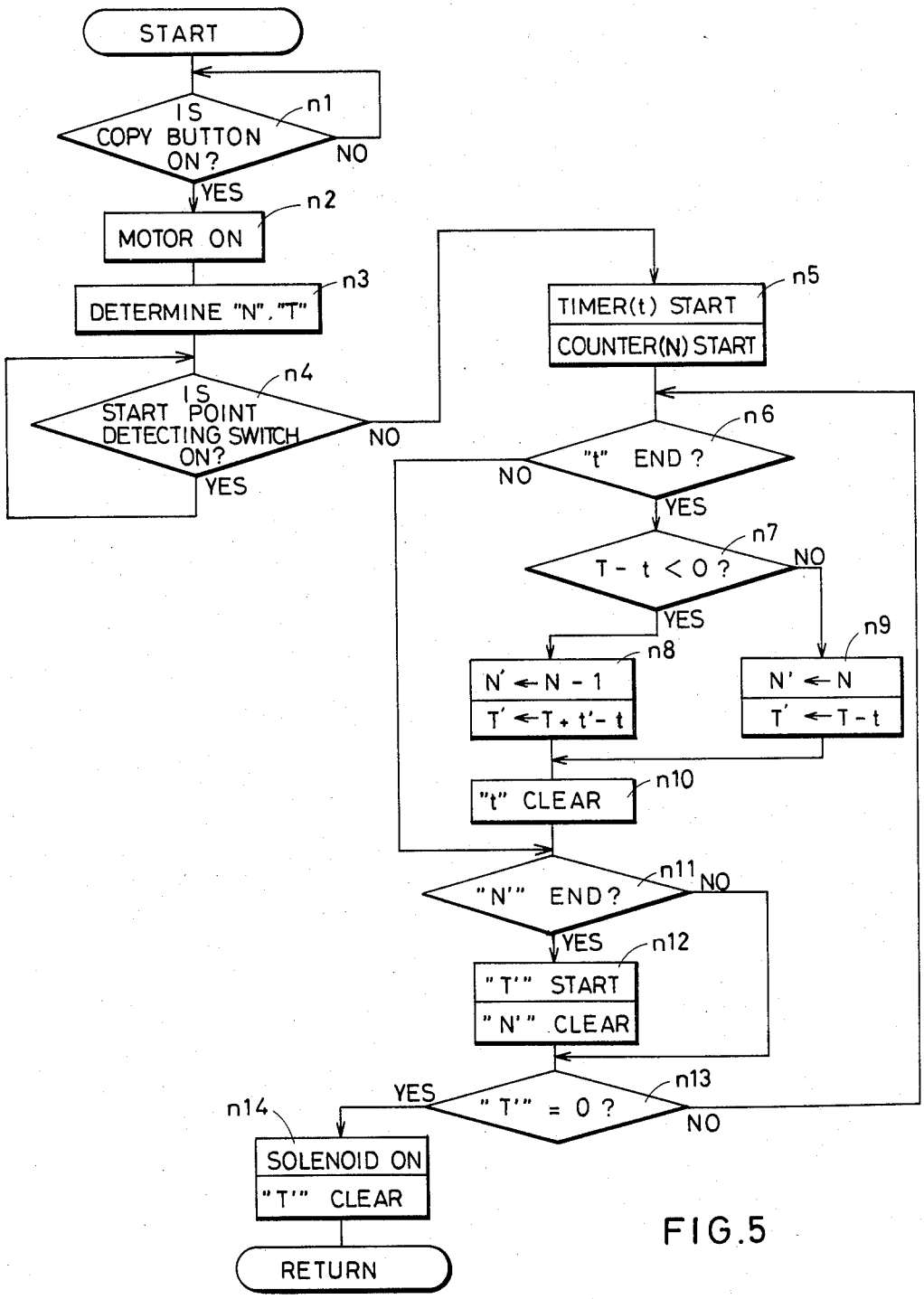
FIG. 5 is a flow chart for explaining an operational mode of the copy paper supply timing control system of FIG. 2.

The operational flow shown in FIG. 5 is controlled by a program stored in a read only memory (ROM) included in the control LSI 20. When the actuation of the copy button 13 is detected at the step n1, the motor relay 17 is enabled at the step n2 to initiate the rotation of the photosensitive drum 2 and the automatic supply roller 10. At the following step n3, the setting condition of the adjusting switch array 15 is read to modify the reference values $N_0$ and $T_0$, whereby the modified values N and T are written into the memory areas A1 and A2, respectively. When the starting of the optical system 6 is detected at the step n4 (the optical system start point detecting signal D changes to the logic low), the operation is advanced to the step n5 to start the counting operation of the timer (t) (memory area A4) and the counter (N) (memory area A5). Before the first slit pulse is detected, that is, before time t has expired, the operation is skipped from the step n6 to the step n11 and returned to the step n6. Specifically, when it is determined at step n6 that period t, until the first pulse is detected, has not expired, the program moves to step n11. At n11 it is determined whether N′ pulses have been counted. Since none have yet been counted, the program moves to step n13 where it is determined if the period T′ has passed following the last of the N′ pulses to be counted. Since this likewise has not yet occurred, the program returns to step n6. This continues until the first pulse is detected, ending the period t. When the slit pulse is detected at the step n6, the time counting operation of the time period (t) is terminated and the obtained time period (t) is stored in the memory area A4. At the following step n7, the time period (t) stored in the memory area A4 is compared with the preselected time (T) stored in the memory area A2. If the time period (t) is longer than the preselected time (T), the operation is advanced to the step n8, where the desired pulse number (N′) ($=N-1$) is introduced into the memory area A6 and the desired time period (T′) ($=T+t'-t$) is introduced into the memory area A7. If the time period (t) is shorter than or equal to the preselected time (T), the operation is advanced to the step n9, where the desired pulse number (N′) ($=N$) is introduced into the memory area A6 and the desired time period (T′) ($=T-t$) is introduced into the memory area A7. At the following step n10, the timer (t) (memory area A4) is cleared, and the slit pulse counting operation is conducted at the step n11. When the slit pulse is counted to the desired number (N′), the operation is advanced from the step n11 to the step n12 to initiate the down counting operation of the period (T′). That is, the reference clock signal of the control LSI 20 is applied to the memory area A7 to count down the period (T′) stored therein. When the contents stored in the memory area A7 reach zero, that is, when the time period (T′) has passed after the last slit pulse, the operation is advanced from the step n13 to the step n14. The solenoid 19 is energized to initiate the rotation of the paper supply timing roller 12, whereby the copy paper is advanced to the transcription section.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A copy paper supply timing control system for a copying machine comprising:

a slit plate secured to a shaft of a photosensitive drum of the machine, said slit plate having a plurality of slits formed with a predetermined distance therebetween;

detection means for detecting said slits formed in said slit plate and for developing a slit detection pulse of a period (t′) when said slit plate rotates;

optical system start detecting means for developing an optical system start signal when an optical system of the machine starts its movement;

memory means for memorizing a desired delay time from the development of said optical system start signal to a supply timing of a copy paper, said memory means including;

a first memory for memorizing a desired number (N) of the slit detection pulses; and a second memory for memorizing a desired time (T) from the development of the N-th slit detection pulse to the supply timing of the copy paper; and control means for developing a control signal for performing the copy paper supply when said desired delay time equalling $N \cdot t' + T$ has passed after the development of said optical system start signal, said control means comprising:

a timer for counting a time period (t) from the development of said optical system start signal to the development of a first slit detection pulse; and compensation means for modifying said desired number (N) stored in said first memory and said desired time (T) stored in said second memory in accordance with said time period (t) counted by said timer.

2. The copy paper supply timing control system of claim 1, said compensation means comprising:

determination means for determining whether said time period (t) is longer than said desired time (T); and calculation means for calculating a modified number (N′) and a modified time (T′) in response to a determination output from said determination means wherein, when $t \leqq T$, $N'=N$ and $T'=T-t$, and wherein, when $t>T$, $N'=N-1$ and $T'=T+t'-t$, whereby said control signal is developed from said control means when said N′ slit detection pulses are counted and the time T′ has passed after counting N′ pulses.

* * * * *